US007550685B2

(12) United States Patent
Tsuduki

(10) Patent No.: US 7,550,685 B2
(45) Date of Patent: Jun. 23, 2009

(54) COMPOUND OPERATION INPUT DEVICE

(75) Inventor: Shiro Tsuduki, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/081,339

(22) Filed: Apr. 15, 2008

(65) Prior Publication Data

US 2008/0257704 A1 Oct. 23, 2008

(30) Foreign Application Priority Data

Apr. 18, 2007 (JP) ..... 2007-109098

(51) Int. Cl.
*H01H 25/04* (2006.01)

(52) U.S. Cl. ..... 200/6 A; 200/4; 200/5 R; 200/14

(58) Field of Classification Search ..... 200/4, 200/5 R, 6 A, 17 R, 18; 341/20, 35; 345/157, 345/161, 184
See application file for complete search history.

(56) References Cited

U.S. PATENT DOCUMENTS 7,087,848 B1 * 8/2006 Yamasaki et al. ..... 200/6 A
7,297,882 B2 * 11/2007 Badarneh ..... 200/5 R
7,312,411 B2 * 12/2007 Osada ..... 200/6 A
7,368,673 B2 * 5/2008 Sato ..... 200/5 R
7,405,728 B2 * 7/2008 Arakawa et al. ..... 345/184
7,442,886 B2 * 10/2008 Hashida ..... 200/5 R
7,462,787 B1 * 12/2008 Kang et al. ..... 200/4
7,498,527 B2 * 3/2009 Koizumi et al. ..... 200/5 R

FOREIGN PATENT DOCUMENTS

JP 2001-325859 11/2001

* cited by examiner

*Primary Examiner*—Michael A Friedhofer
(74) *Attorney, Agent, or Firm*—Kratz, Quintos & Hanson, LLP

(57) ABSTRACT

A compound operation input device includes: an first operating body that can be pressed in a direction substantially orthogonal to a circuit board; an second operating body of annular shape, disposed around the first operating body and substantially parallel to the circuit board, tilt operable, and rotatably operable; a first switch actuable in response to pressing movement of the first operating body; second switches independently actuable in response to tilt movement of the second operating body; an attachment having an outer portion, the second operating body being provided with the outer portion, and an inner portion facing the second face of the first operating body; and a rotation detector for detecting rotation of the second operating body. The rotation detector is attached to an inner portion of the attachment and disposed in a space between the circuit board and the first operating body and inside the second switches.

6 Claims, 6 Drawing Sheets

(a)

(b)

COMPOUND OPERATION INPUT DEVICE

The present application claims priority under 35 U.S.C. §119 of Japanese Patent Application No. 2007-109098 filed on Apr. 18, 2007, the disclosure of which is expressly incorporated by reference herein in its entity.

BACKGROUND OF THE INVENTION

1. Field of the Invention

The present invention relates to a compound operation input device for pressing operation input, tilt operation input, and rotating operation input.

2. Description of the Related Art

A known compound operation input device of this type includes a first operating body that can be pressed in a vertical direction, a second operating body of annular shape disposed around the first operating body, tilt operable and rotatably operable in a circumferential direction, a first switch to be actuated by pressing movement of the first operating body, a plurality of second switches to be actuated by tilt of the second operating body, a rotary switch attached to the second operating body to detect rotation of the second operating body, a first circuit board provided with the first and second switches, and a second circuit board formed with sliding contact patterns of the rotary switch (see Japanese Unexamined Patent Publication No. 2001-325859).

In the above known device, the second operating body is in annular shape and disposed around the first operating body. Therefore, outer sizes of the second operating body and the rotary switch attached thereto depend on the outer size of the first operating body. By reducing the outer size of the first operating body, it is possible to reduce the outer size of the second operating body and the rotary switch.

It should be noted that the first operating body needs to be pressed for input operation. Therefore, if the outer size of the first operating body is reduced, the first operating body should become difficult to operate. For this reason, it is difficult to reduce the outer size of the device.

The present invention has been made in view of the above circumstance and aims to provide a compound operation input device that can be reduced in size by reducing the outer size of a rotary switch irrespective of the outer size of a first operating body.

SUMMARY OF THE INVENTION

To achieve the above object, the present invention aims to provide a compound operation input device including a first operating body, pressably operable in a direction substantially orthogonal to a circuit board, and having a first face exposed for operation and a second face opposite from the first face; a second operating body of annular shape, disposed around the first operating body and substantially parallel to the circuit board, tilt operable in any radial direction from the parallel state, and rotatably operable in a circumferential direction; a first switch actuable in response to pressing movement of the first operating body; a plurality of second switches independently actuable in response to tilt movement of the second operating body; a rotation detector for detecting rotation of the second operating body; and an attachment including an outer portion, the second operating body being provided with the outer portion, and an inner portion facing the second face of the first operating body. The plurality of second switches is disposed in an outer area on the circuit board outside an area on the circuit board facing the first operating body. The rotation detector is attached to the inner portion of the attachment and disposed in a space between the circuit board and the first operating body and inside the plurality of second switches.

Because the rotation detector is attached to the second operating body via the attachment and disposed in the space between the circuit board and the first operating body and inside the plurality of second switches as described above, it is possible to reduce the outer size of the rotation detector irrespective of the outer size of the first operating body.

The first operating body may be configured to include an operation portion having the first face and the second face, and a rod-shaped operation shaft protrudingly provided on a portion of the second face of the operation portion and having a smaller outer size than the operation portion. In this case, the inner portion of the attachment may face the remaining portion of the second face of the operation portion.

In other words, the inner portion of the attachment may be disposed in a space between the circuit board and the operation portion and around the operation shaft, and the rotation detector is disposed in this space.

The rotation detector may include a rotating body having one heightwise end portion attachable to the inner portion of the attachment, a central portion of the rotating body being provided with a through-hole for receiving the operation shaft therethrough; a contact provided on the other heightwise end portion of the rotating body; and a contact pattern provided in the area on the circuit board facing the first operating body, the contact being slidable on the contact pattern.

The attachment may include a ring-shaped plate body attachable to the second operating body; and an arm extending from an inner face of the plate body. In this case, the arm may have two bent pieces on opposite sides of a distal end portion thereof, and said one heightwise end portion of the rotating body may be provided with a notch for fitting the arm therein.

If the arm is fitted in the notch of the rotating body as described above, the bent pieces press end faces of the notch in response to rotation of the second operating body to rotate the rotating body.

The compound operation input device may further include a key top of annular shape, disposed between the second operating body and the second switches and substantially parallel to the circuit board, and tiltable in response to tilt movement of the second operating body so as to press the associated second switch; and a tactile element provided on an area of the second operating body facing the key top. In this case, a face of the key top facing the tactile element may be uneven, and the tactile element may slide on the face of the key top facing the tactile element.

As described above, the key top may perform dual functions, namely, pressing down the second switches, and giving a tactile feeling of operation to the rotating operation of the second operating body with the help of the tactile element. Therefore, the number of parts can be reduced as compared with other compound operation input devices having separate components for performing the respective functions. As a result, the invention contributes to reduced size and reduced cost of the device.

The second operating body may includes a ring-shaped operation plate having a first face exposed for operation and a second face opposite from the first face; a cylindrical outer wall extending from an outer edge portion of the second face of the operation plate; and a cylindrical inner wall extending from an inner edge portion of the second face of the operation plate. In this case, the tactile element may be attached between the outer wall and the inner wall of the second face of the operation plate. The outer portion of the attachment may be attached to the inner wall such that an outer end portion of the outer portion faces the second face of the operation plate. The key top may be supported on the outer end portion of the outer portion of the attachment and housed in a space between the outer wall and the inner wall.

By housing the key top and the tactile element in the space between the outer wall and the inner wall as described above, it is possible to facilitate assembly of the key top and the tactile element, leading to reduced height of the device.

In the compound operation input device according to the present invention, the rotation detector is attached to the second operating body via the attachment and is disposed in the space between the circuit board and the first operating body and inside the plurality of second switches. The invention can thus reduce the outer size of the rotation detector irrespective of the outer size of the first operating body. Moreover, because the rotation detector is disposed in the space between the circuit board and the first operating body and inside the plurality of second switches (i.e., a dead space), it is possible to reduce the outer size of the device and eventually to reduce the device in size.

BRIEF DESCRIPTION OF THE DRAWINGS

FIG. 1A is a schematic plan view and FIG. 1B is a schematic perspective view;

FIG. 4A is a view from above and FIG. 4B is a view from below;

FIG. 5A is a view from above and FIG. 5B is a view from below; FIG. 6A is a schematic plan view and FIG. 6B is a schematic bottom view.

DETAILED DESCRIPTION OF PREFERRED EMBODIMENTS

Figure 1:
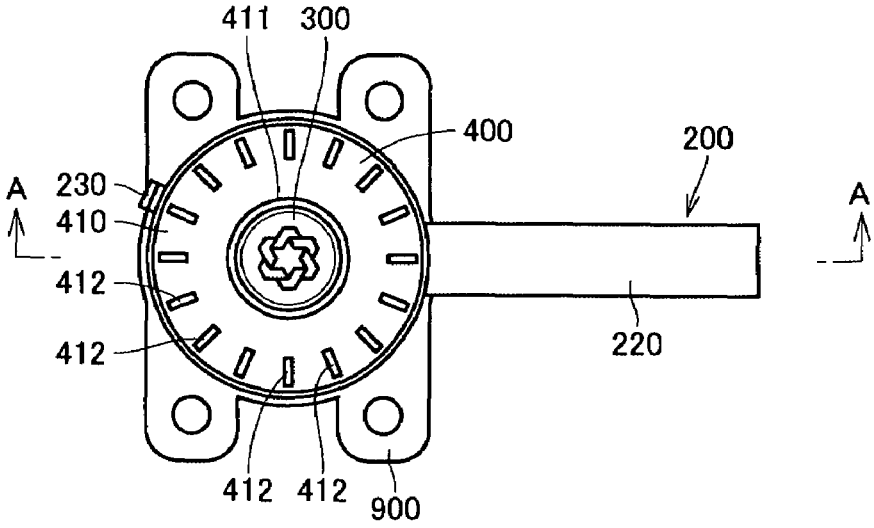
FIGS. 1A and 1B are diagrams showing a compound operation input device according to an embodiment of the present invention, where
Figure 1:
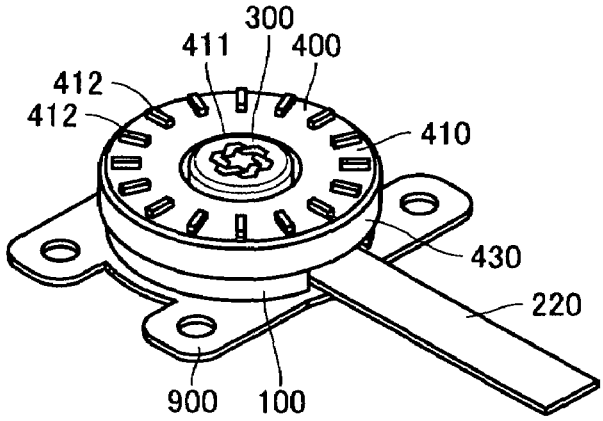
Figure 2:
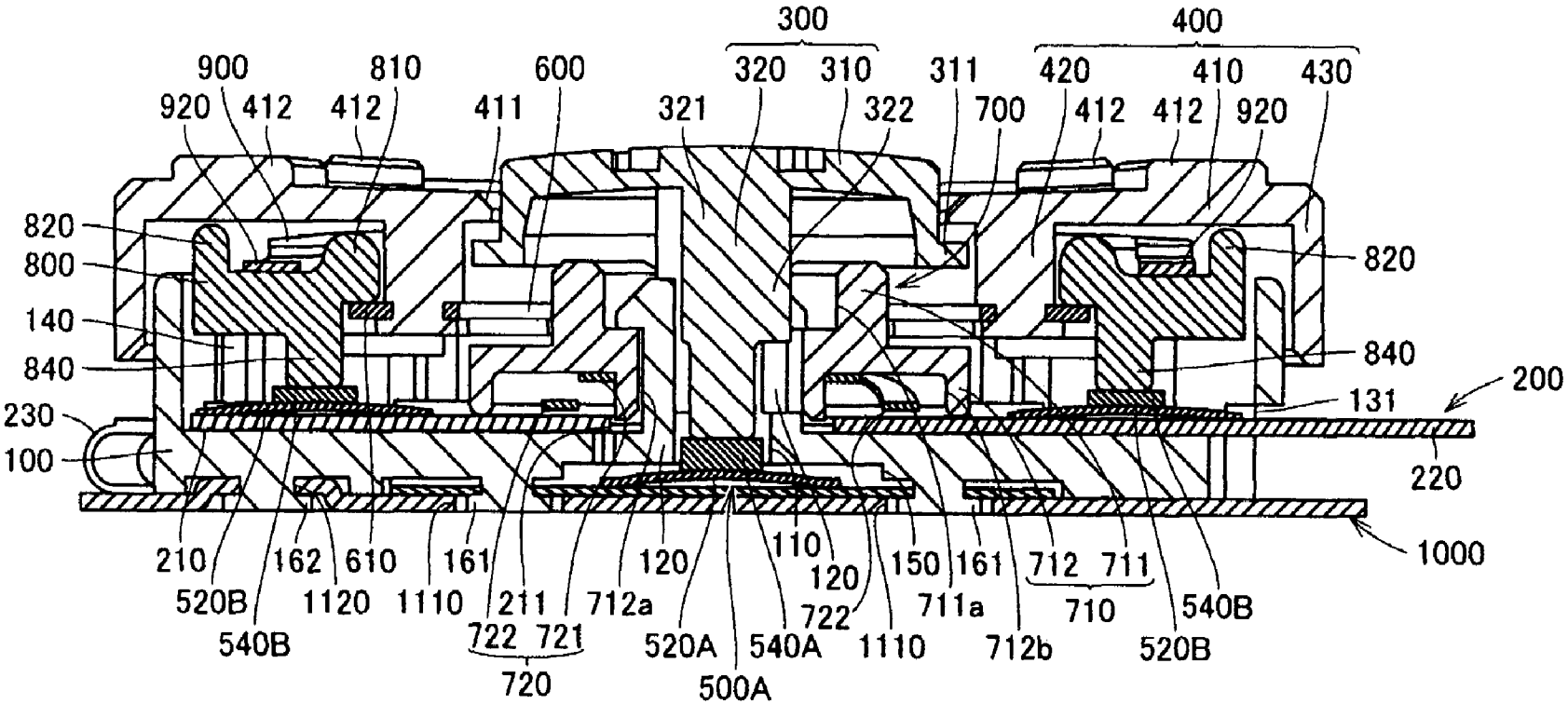
FIG. 2 is a sectional view of the device taken along a line A-A in FIG. 1.
Figure 3:
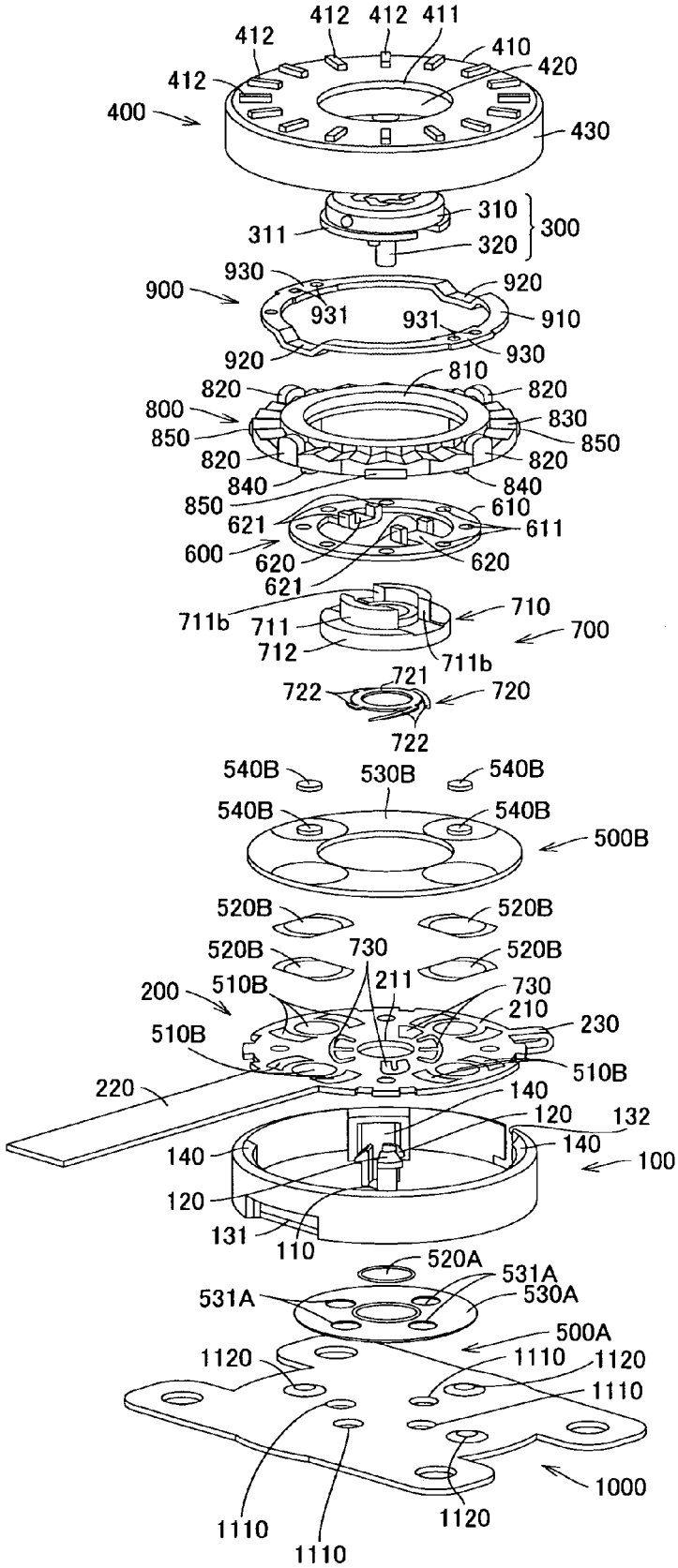
FIG. 3 is a schematic exploded perspective view of the device.
Figure 4:
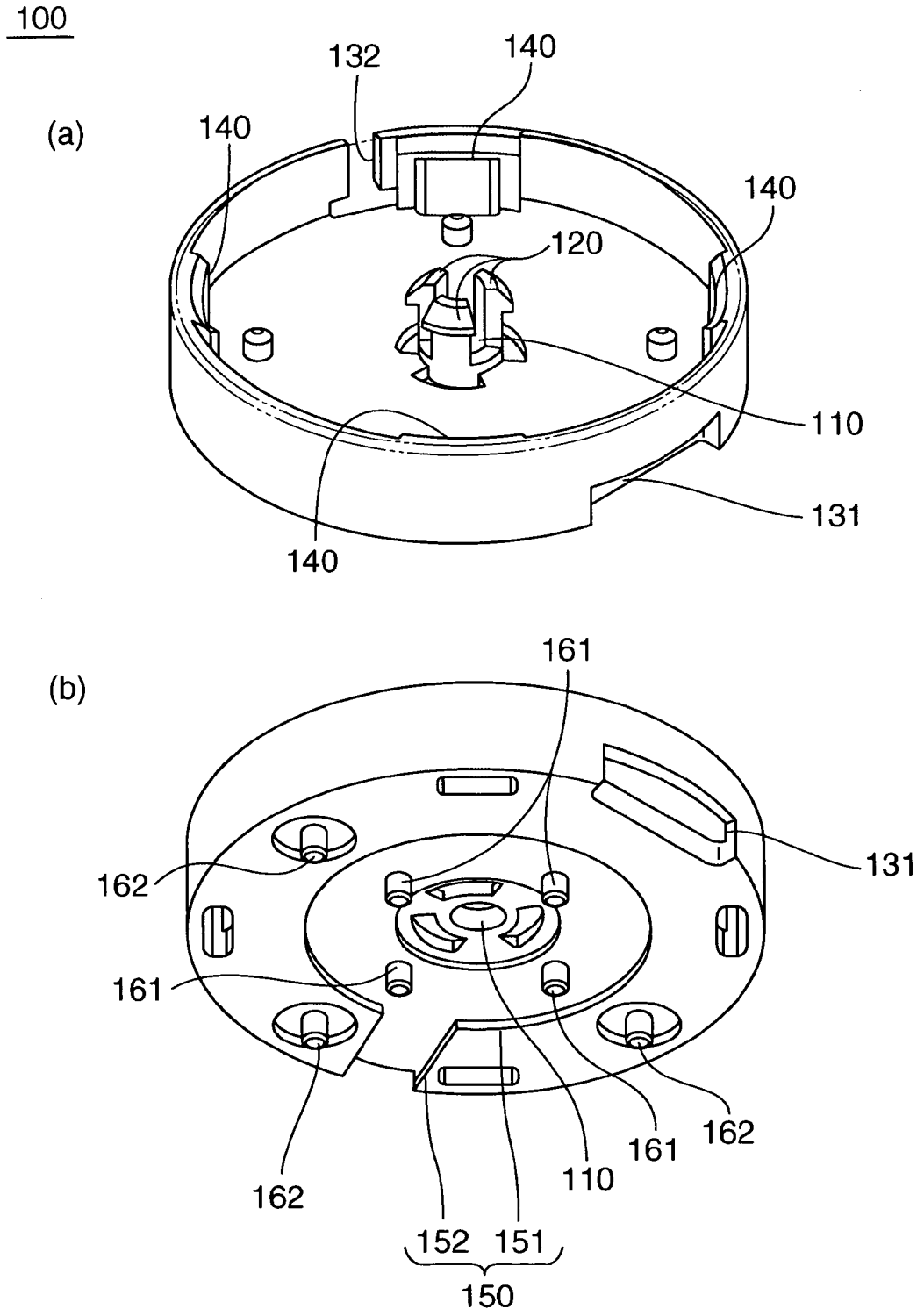
FIGS. 4A and 4B are schematic perspective views showing a case of the device, where
Figure 5:
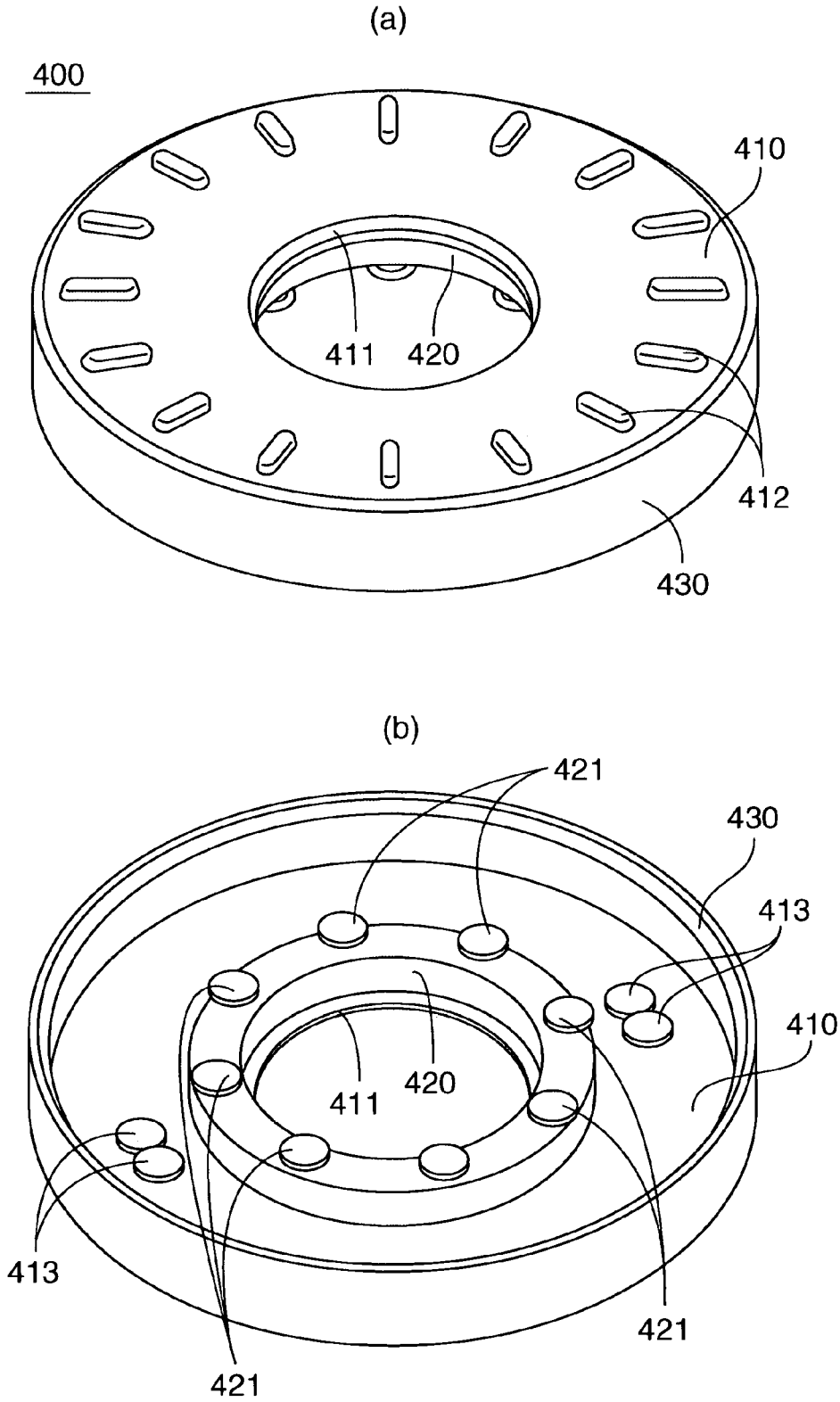
FIGS. 5A and 5B are schematic perspective views showing a second operation body of the device, where
Figure 6:
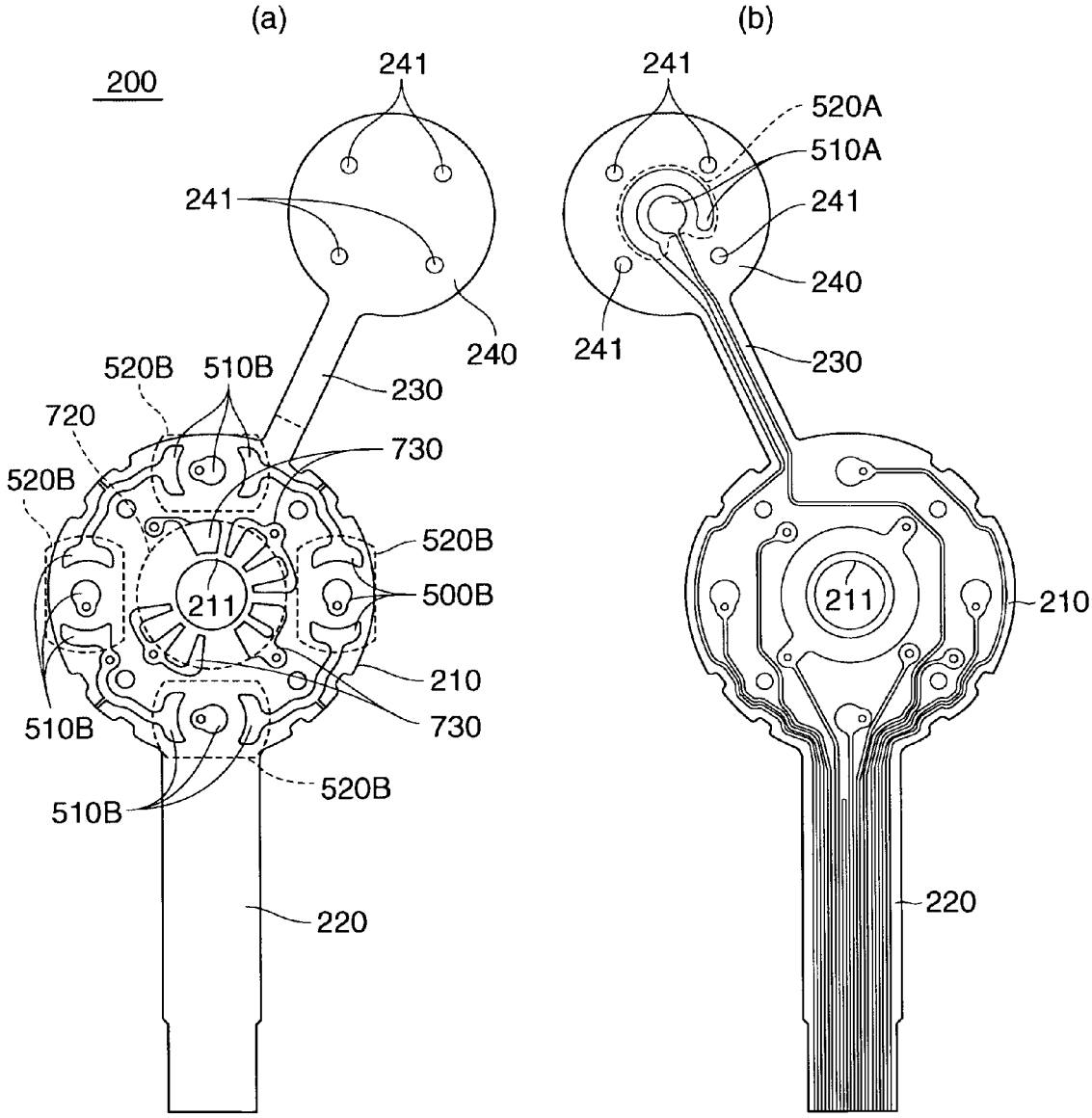
FIGS. 6A and 6B are diagrams showing a board of the device, where

A compound operation input device according to an embodiment of the present invention will be described below with reference to the drawings. FIGS. 1(*a*) and 1(*b*) are diagrams showing the compound operation input device according to the embodiment the present invention, where FIG. 1(*a*) is a schematic plan view and FIG. 1(*b*) is a schematic perspective view. FIG. 2 is a sectional view of the device taken along a line A-A in FIG. 1. FIG. 3 is a schematic exploded perspective view of the device. FIGS. 4(*a*) and 4(*b*) are schematic perspective views showing a case of the device, where FIG. 4(*a*) is a view from above and FIG. 4(*b*) is a view from below. FIGS. 5(*a*) and 5(*b*) are schematic perspective views showing a second operating body of the device, where FIG. 5(*a*) is a view from above and FIG. 5(*b*) is a view from below. FIGS. 6(*a*) and 6(*b*) are diagrams showing a circuit board of the device, where FIG. 6(*a*) is a schematic plan view and FIG. 6(*b*) is a schematic bottom view.

The compound operation input device described herein includes: a case 100; a circuit board 200 set on an upper face of a bottom plate of the case 100; a first operating body 300 that can be pressed down in a direction substantially orthogonal to the circuit board 200; a second operating body 400 of annular shape, being disposed around the first operating body 300 to be substantially parallel to the circuit board 200, tilt operable in four radial directions from the parallel state, and rotatably operable in a circumferential direction; a first switch 500A disposed to face the first operating body 300; second switches 500B disposed to correspond to respective four tilting directions of the second operating body 400; an attachment 600 to be mounted on the second operating body 400; a rotation detector 700 mounted on the attachment 600 to detect rotation of the second operating body 400; a key top 800 disposed between the second operating body 400 and the second switches 500B; a tactile element 900 provided on a face of the second operating body 400 facing the key top; and a reinforcing plate 1000 mounted to a lower face of the bottom plate of the case 100. Each of the above elements will be described below in detail.

The case 100 is made of plastics material and molded in a cup shape as shown in FIGS. 1(*a*) to 4(*b*). It has the circular bottom plate and a cylindrical wall rising from an outer peripheral edge of the bottom plate.

The central portion of the bottom plate of the case 100 has a first hole 110 for inserting therethrough an operation shaft 320 of the first operating body 300.

Along a peripheral edge portion of the first hole 110 on the upper face of the bottom plate of the case 100, three support members 120 are provided at equal intervals as shown in FIGS. 2, 3, and 4(*a*). Each of the support members 120 has a support portion with an arc-shaped outer peripheral face and a locking hook. The support portion may be inserted into a rotation hole 712*a* of a rotating body 710 of the rotation detector 700 so as to support the rotating body 710 so that the rotating body 710 can rotate in a circumferential direction. The locking hook may be locked in a locking hole 711*a* of the rotating body 710 of the rotation detector 700.

As shown in FIGS. 2 and 4(*b*), outside the peripheral edge of the first hole 110 on the lower face of the bottom plate of the case 100, there is formed a recessed housing portion 150 for housing a sub-board 240 of the circuit board 200 and the first switch 500A. The housing portion 150 has a circular recessed portion 151 and a rectangular recessed portion 152 continuous with the circular recessed portion 151. The circular recessed portion 151 is shaped like two concentric recesses with different diameters that are vertically joined. The rectangular recessed portion 152 is open toward an outer peripheral face of the bottom plate of the case 100.

On the lower face of the circular recessed portion 151, as shown in FIGS. 2 to 4(*b*) and FIGS. 6(*a*) and 6(*b*), four first engaging protrusions 161 are provided at intervals of 90° around the first hole 110. The first engaging protrusions 161 are respectively engaged in four engaging holes 241 formed in the sub-board 240 of the circuit board 200 and four engaging holes 531A formed in a first fixing sheet 530A and are respectively fitted in four housing holes 1110 formed in the reinforcing plate 1000. On the lower face of the bottom plate of the case 100 and around the housing portion 150, three second engaging protrusions 162 are provided. The second engaging protrusions 162 are respectively engaged in three engaging holes 1120 formed in the reinforcing plate 1000.

As shown in FIGS. 2, 3, and 4(*a*), the wall of the case 100 is provided with a first lead-out hole 131 for leading out a led-out portion 220 of the circuit board 200, a second lead-out hole 132 for leading out a folded-back piece 230 of the circuit board 200, and four recessed guiding portions 140 for guiding four guide protrusions of the key top 800.

The first lead-out hole 131 is positioned between two of the recessed guiding portions 140. The second lead-out hole 132 is provided in a position between the remaining two recessed guiding portions 140 and above the rectangular recessed portion 152 of the housing portion 150.

As shown in FIGS. 2, 3, 6(*a*), and 6(*b*), the circuit board 200 is a flexible board and has a disk-shaped main board 210 to be set on the upper face of the bottom plate of the case 100, the plate-shaped led-out portion 220 provided at a part of an outer periphery of the main board 210, the plate-shaped folded-back piece 230 provided at another part of the outer periphery of the main board 210 and having a smaller width than the led-out portion 220, and the disk-shaped sub-board 240 provided at a distal end of the folded-back piece 230.

A central portion of the main board 210 is provided with a second hole 211 for inserting thereinto the three support members 120. The second hole 211 is disposed concentrically with the first hole 110 when the main board 210 is set on the upper face of the bottom plate of the case 100.

The led-out portion 220 is led out of the case 100 through the first lead-out hole 131 of the case 100 and connected to an electronic device not shown in the drawings.

The folded-back piece 230 has a rear end portion and a distal end portion. The rear end portion is led outside the case 100 through the second lead-out hole 132 of the case 100 and is folded back into a substantially U shape lying on its side in a sectional view as shown in FIG. 2. The distal end portion is housed in the rectangular recessed portion 152 of the housing portion 150 of the case 100.

The sub-board 240 is housed in the circular recessed portion 151 of the housing portion 150 with the distal end portion of the folded-back piece 230 housed in the rectangular recessed portion 152 of the housing portion 150. The sub-board 240 has the four engaging holes 241 at intervals of 90° for inserting therethrough the four first engaging protrusions 161.

The second operating body 400 is made of plastics material and molded in a cup shape to cover the case 100 as shown in FIGS. 3, 5(*a*), and 5(*b*). The second operating body 400 has an operation plate 410, a cylindrical inner wall 420 extending vertically from an inner rim portion of a lower face of the operation plate 410, and a cylindrical outer wall 430 extending vertically from an outer rim portion of the lower face of the operation plate 410.

The operation plate 410 is a ring-shaped plate-shaped body with a central hole 411 at its central portion. The outer diameter of the operation plate 410 is greater than the outer diameter of the bottom plate of the case 100.

An upper face (first face) of the operation plate 410 is an operation face to be operated and, for ease in operation, provided with a plurality of protrusions 412 oriented radially from a center of the operation plate 410. The lower face (second face) of the operation plate 410 has four protrusions 413 to be respectively inserted and welded into twins of holes 931 of two attaching portions 930 of the tactile element 900.

A lower face of the inner wall 420 has a plurality of protrusions 421 to be respectively inserted and welded into a plurality of holes 611 in a plate body 610 of the attachment 600. A space between the inner wall 420 and the outer wall 430 serves as a housing space for housing the key top 800 and the tactile element 900.

The outer wall 430 extends along an outer face of the wall of the case 100 in a state where the second operating body 400 covers the case 100.

The rotation detector 700 is a rotary switch including, as shown in FIGS. 2, 3, and 6(*a*), the rotating body 710, a contact 720 rotatable in accordance with the rotation of the rotating body, and a plurality of contact patterns 730 on which the contact 720 can slide.

The rotating body 710 has a cylindrical upper stage 711 and a cylindrical lower stage 712, as shown in FIGS. 2 and 3. The lower stage 712 is provided on a lower face of the upper stage 711 and has a greater outer diameter than the upper stage 711.

At a central portion of the lower stage 712, there is provided with a rotation hole 712*a* into which the three support members 120 of the case 100 are to be fitted. The lower stage 712 is thus rotatably supported on the three support members 120, and thereby the rotating body 710 is rotatably attached to the case 100. Consequently, the rotation detector 700 is disposed in a space between the main board 210 of the circuit board 200 and an operation portion 310 of the first operating body 300 (i.e., above the main board, and below the operation portion 310 of the first operating body 300—the side to which an operation portion 310 is pressed down) and inside the second switches 500B.

A lower face of the lower stage 712 (i.e., the other end portion in a height direction) is provided with an annular housing recessed portion 712*b* for housing the contact 720.

A central portion of the upper stage 711 is provided with an locking hole 711*a* communicating with the rotation hole 712*a* of the lower stage 712. The diameter of the locking hole 711*a* is greater than the diameter of the rotation hole 712*a*. In other words, the locking hooks of the three support members 120 of the case 100 are locked in the locking hole 711*a*, or on a peripheral edge portion of the rotation hole 712*a*. This configuration can prevent the rotating body 710 slipping off from the case 100. The rotation hole 712*a* and the locking hole 711*a* are formed as through-holes.

The upper stage 711 (i.e., one end portion in the height direction) is provided in its opposed two positions with two notches 711*b*. These notches 711*b* fittingly receives two respective arms 620 of the attachment 600.

As shown in FIGS. 2 and 3, the contact 720 has a ring-shaped base plate 721 and four contact arms 722 provided continuously on an outer peripheral face of the base plate 721.

The base plate 721 is mounted on a bottom face of the housing recessed portion 712*b*.

The contact arms 722 slide on the plurality of contact patterns 730 in accordance with the rotation of the rotating body 710 as the second operating body 400 rotates.

As shown in FIG. 6, the plurality of contact patterns 730 are arranged in spaced relationship along a peripheral edge portion of the second hole 211 on the upper face of the main board 210 of the circuit board 200 (i.e., an area on the main board 210 opposed to the operation portion 310 of the first operating body 300).

As shown in FIGS. 2 and 3, the attachment 600 has the ring-shaped plate body 610 (i.e., an outer portion) and the two opposed arms 620 (i.e., inner portions) extending from an inner face of the plate body 610.

The plate body 610 is provided with the plurality of holes 611 into which the plurality of protrusions 421 of the second operating body 400 are respectively inserted and welded. In other words, the plate body 610 is fixed by welding to the lower face of the inner wall 420 of the second operating body 400. The outer diameter of the plate body 610 is greater than the outer diameter of the inner wall 420. Therefore, in a state where the plate body 610 is mounted to the lower face of the inner wall 420, an outer rim portion (i.e., outer end portion) of the plate body 610 juts out over the inner wall 420 and faces the lower face of the operation plate 410. This outer edge portion of the plate body 610 functions to support a first protrusion 810 of the key top 800 in the above described housing space.

The arms 620 are rectangular plate-shaped bodies. The arms 620 face an outer peripheral portion of a bottom face of the operation portion 310 of the first operating body 300 in a state where the plate body 610 is attached to the lower face of the inner wall 420. The arms 620 are loosely fitted in the notches 711*b* of the rotating body 710 of the rotation detector 700. The arms 620 each have two bent pieces 621 at opposite widthwise ends of a distal end portion thereof. The bent pieces 621 are oriented substantially perpendicular to the arm 620.

The bent pieces 621 are opposed to end faces of the notches 711*b* in a state where the arms 620 are fitted in the notches 711*b*. As a result, when the attachment 600 rotates in accordance with the rotation of the second operating body 400, the bent pieces 621 come in contact with and press the end faces of the notches 711*b*. In this way, the rotating body 710 is attached to the two arms 620 of the attachment 600 to allow the rotating body 710 to rotate in accordance with the rotation of the second operating body 400.

It should be noted that the arms 620 are loosely fitted in the notches 711*b* and their bent pieces 621 face the end faces of the notches 711*b*. In other words, the arms 620 can swing within the notches 711*b* in two directions along a longitudinal direction of the arms 620 and two directions along a width direction of the arms 620, in accordance with the tilt of the attachment 600 caused by the tilt of the second operating body 400. At this time, the two bent pieces 621 are arranged so as not to interfere with the rotating body 710. Therefore, the second operating body 400 may be tilted in the two directions along the longitudinal direction of the arms 620 and the two directions along the direction orthogonal to the longitudinal direction.

As shown in FIGS. 2 and 3, the tactile element 900 has a tactile element main body 910 that is a ring-shaped leaf spring, two sliding portions 920 provided in opposed two positions of the tactile element main body 910 and curved into arc shapes, and the two attaching portions 930 provided in two positions each displaced at 90° from the sliding portions 920 of the tactile element main body 910.

The attaching portions 930 each are provided with two holes 931. The two holes 931 respectively receive and are attached by welding to the two protrusions 413 of the operation plate 410 of the second operating body 400. As a result, the attaching portions 930 are mounted to the lower face of the operation plate 410 of the second operating body 400.

The sliding portions 920 slide on an uneven face 830 of the key top 800 in accordance with the rotation of the second operating body 400. In this way, rotating operation of the second operating body 400 can be felt by a user of the input device.

As shown in FIGS. 2 and 3, the key top 800 made of plastics material and molded in a ring shape. The key top 800 has the cylindrical first protrusion 810 provided along an inner rim of an upper face of the key top 800, four second protrusions 820 spaced every 90 degrees along the outer rim of the upper face, the uneven face 830 provided in the remaining areas of the upper face, four pressing-down portions 840 provided on a lower face at the same spacing as the second protrusions 820, and four guide protrusions 850 provided to protrude outward from four positions of an outer peripheral face between the second protrusions 820 and the pressing-down portions 840.

As shown in FIG. 2, the first protrusion 810 protrudes not only upward but also inward. The inner protruding portion of the first protrusion 810 is supported on the outer rim portion of the plate body 610 of the attachment 600 mounted to the inner wall 420 of the second operating body 400. As a result, the key top 800 is retained in the housing space between the inner wall 420 and the outer wall 430 of the second operating body 400.

The inner diameter of the first protrusion 810 is slightly greater than the outer diameter of the inner wall 420 of the second operating body 400. Therefore, the first protrusion 810 is arranged along an outer face of the inner wall 420 in a state where the key top 800 is retained in the housing space.

The second protrusions 820 are slightly higher than the first protrusion 810 and are in contact with the lower face of the operation plate 410 of the second operating body 400. Due to the contact of the second protrusions 820 with the lower face of the operation plate 410, a space for housing the tactile element 900 is reserved between the key top 800 and the operation plate 410. The second protrusions 820 are pressed down by the operation plate 410 when the second operating body 400 tilts. As a result, the key top 800 tilts as the second operating body 400 tilts.

There are clearances between the second protrusions 820 and the outer wall 430 in a state where the key top 800 is retained in the housing space. The wall of the case 100 is inserted into the clearances.

The guide protrusions 850 are guided by the recessed guiding portions 140 of the wall of the case 100 in a vertically movable manner. The key top 800 is thus guided in tilting movement while circumferential rotation of the key top 800 is prevented.

The pressing-down portions 840 are columnar protrusions protruding downward. The pressing-down portions 840 are disposed in positions corresponding to the tilting directions of the second operating body 400 and placed on four second movable contacts 520B of the second switches 500B in a state where the guide protrusions 850 are guided by the recessed guiding portions 140. By thus supporting the pressing-down portions 840 on the four second movable contacts 520B of the second switches 500B, the key top 800 and the second operating body 400 are supported substantially parallel to the main board 210 of the circuit board 200.

The pressing-down portions 840 press down the second movable contacts 520B of the second switches 500B in accordance with the tilt of the key top 800 caused by the tilt of the second operating body 400.

As shown in FIGS. 3 and 6(*a*), the second switches 500B has four pairs of second fixed contacts 510B, the four second movable contacts 520B of a substantially arc shape in sectional view, a second fixing tape 530B for fixing the second movable contacts 520B to the main board 210, and four second spacers 540B respectively disposed on top of the second movable contacts 520B. The four pairs of second fixed contacts 510B are arranged around the plurality of contact patterns 730 on the upper face of the main board 210 of the circuit board 200 and at four positions corresponding to four tilting directions of the second operating body 400 (i.e., an area on the main board 210 of the circuit board 200 and around the area facing the first operating body 300). Each of the four second movable contacts 520B is placed on one of each pair of the second fixed contacts 510B.

The second movable contacts 520B support the pressing-down portions 840 of the key top 800 through the second spacers 540B. When the top portion of any of the second movable contacts 520B is pressed down by the corresponding pressing-down portion 840 of the key top 800 in accordance with the tilt of the second operating body 400, the pressed second movable contact 520B is elastically deformed to come in contact with the other fixed contacts 510B. Upon release of the pressure, the second movable contact 520B returns to its original state and pushes up the corresponding pressing-down portions 840. As a result, the second operating body 400 is brought back to the parallel state.

As shown in FIG. 6(*b*), the pairs of second fixed contacts 510B are respectively connected to wiring on lower faces of the main board 210 and the led-out portion 220 of the circuit board 200.

As shown in FIGS. 2 and 3, the first operating body 300 has the operation portion 310 and the columnar operation shaft 320 extending downward from a central portion of a bottom face (second face) of the operation portion 310.

The operation portion 310 is made of plastics material and molded in a shape of a round cup turned upside down. Its outer diameter is slightly smaller than the diameter of the central hole 411 of the second operating body 400. In other words, the operation portion 310 is inserted into the central hole 411 of the second operating body 400 and partly exposed outside the central hole 411 so that the operation portion 310 can be operated.

A flange 311 is provided outwardly along an outer peripheral edge of the operation portion 310. The flange 311 abuts an inner edge portion of the central hole 411 of the second operating body 400 to thereby prevent the first operating body 300 slipping out of the second operating body 400.

An upper face (first face) of the operation portion 310 is an operation face to be operated and is provided with recessed portions for ease in operation.

The operation shaft 320 has a columnar operation shaft main body 321 inserted among the three support members 120 and through the first hole 110 of the case 100, and a protrusion 322 provided at an upper end portion of an outer peripheral face of the operation shaft main body 321.

The protrusion 322 is fitted between two of the three support members 120 so as to be guided vertically and prevents circumferential rotation of the first operating body 300.

The operation shaft main body 321 runs among the three support members 120 and through the first hole 110 to face the circular recessed portion 151 of the housing portion 150 of the case 100 and then is placed on the first switch 500A. The first operating body 300 is thus retained in an initial state. When the first operating body 300 is pressed down, the operation shaft main body 321 presses down the first switch 500A.

The first switch 500A has the pair of first fixed contacts 510A provided on a lower face of the sub-board 240, the first movable contact 520A placed on one of the first fixed contacts 510A and having a substantially arc shape in sectional view, the first fixing sheet 530A for fixing the first movable contact 520A to the sub-board 240, and a first spacer 540A placed on a top portion of the first movable contact 520A.

The first fixed contacts 510A of the pair are respectively connected to wiring on the lower faces of the folded-back piece 230, the main board 210, and the led-out portion 220 of the circuit board 200.

The first movable contact 520A supports the operation shaft main body 321 of the operation shaft 320 of the first operating body 300 with the first spacer 540A interposed therebetween. When the top portion of the first movable contact 520A is pressed down by the operation shaft main body 321 through the first spacer 540A, the first movable contact 520A is elastically deformed to come in contact with the other fixed contact 510A. When the first movable contact 520A is released from the pressure, it returns to its original state and pushes up the first operating body 300 into the initial state.

The reinforcing plate 1000 is a plate-shaped body having an insulating property. A central portion of the reinforcing plate 1000 is provided with the four housing holes 1110 for respectively housing the four first engaging protrusions 161 of the case 100. Around the four housing holes 1110 of the reinforcing plate 1000, there are three engaging holes 1120 to be respectively engaged with the three second engaging protrusions 162 of the case 100. By the engagement of the engaging holes 1120 with the second engaging protrusions 162 of the case 100, the reinforcing plate 1000 is attached to the lower face of the bottom plate of the case 100.

An assembly procedure of the compound operation input device having the above structure will be described below. First, the attaching portions 930 of the tactile element 900 are attached to the lower face of the operation plate 410 of the second operating body 400. Then, the operation portion 310 of the first operating body 300 is inserted into the central hole 411 in the second operating body 400.

In this state, the key top 800 is inserted into the housing space between the inner wall 420 and the outer wall 430 of the second operating body 400. The plate body 610 of the attachment 600 is fixed by welding to the lower face of the inner wall 420. As a result, the first protrusion 810 of the key top 800 is supported on the outer edge portion of the plate body 610 and housed in the housing space. In this way, the first operating body 300, the second operating body 400, the tactile element 900, the key top 800, and the attachment 600 are unitized.

Then, each of the four second movable contacts 520B is placed on one of the paired second fixed contacts 510B on the main board 210 of the circuit board 200. Then, the second movable contacts 520B are mounted onto the main board 210 of the circuit board 200 with the second fixing tape 530B.

The led-out portion 220 of the circuit board 200 is positioned to and inserted into the first lead-out hole 131 of the case 100. At the same time, the rear end portion of the folded-back piece 230 of the circuit board 200 is positioned to and inserted into the second lead-out hole 132 of the case 100. In this way, the main board 210 of the circuit board 200 is set on the bottom plate of the case 100. At this time, the three support members 120 of the case 100 are fitted in the second hole 211 of the main board 210.

Then, the base plate 721 of the contact 720 is attached to the bottom face of the housing recessed portion 712*b* of the rotating body 710 of the rotation detector 700. The three support members 120 of the case 100 are inserted into the rotation hole 712*a* of the rotating body 710. As a result, the locking hooks of the three support members 120 abut the inner peripheral surface of the rotation hole 712*a* of the rotating body 710 and the support portions of the support members 120 are elastically deformed inward. Then, the locking hooks of the support members 120 are locked in the locking hole 711*a* of the rotating body 710, i.e., on a peripheral edge portion of the rotation hole 712*a*. In this way, the rotation detector 700 is attached rotatably in a circumferential direction in a space around the operation shaft 320 of the first operating body 300 on the main board 210 (i.e., a space between the main board 210 and the operation portion 310 of the first operating body 300 and inside the second switches 500B).

Then, the four second spacers 540B are respectively placed on the four second movable contacts 520B. The second operating body 400 unitized as described above is placed over the case 100. As a result, the wall of the case 100 is inserted into the clearance between the second operating body 400 and the second protrusions 820 of the key top 800. At the same time, four pressing-down portions 840 of the key top 800 are respectively placed on the four second spacers 540B. In this way, the four second spacers 540B are respectively retained between the four second movable contacts 520B and the four pressing-down portions 840 of the key top 800.

At this time, the operation shaft main body 321 of the first operating body 300 is positioned and inserted among the three support members 120 and into the first hole 110 of the case 100. As a result, the protrusion 322 of the first operating body 300 is fitted between the two support members 120.

Then, the first spacer 540A is inserted into the first hole 110 of the case 100 from a lower face side of the case 100. As a result, the first spacer 520A comes into contact with a distal end face of the operation shaft main body 321 of the first operating body 300.

Then, the first movable contact 520A is placed on one of the paired first fixed contacts 510A on the lower face of the sub-board 240 of the circuit board 200. Then, the first fixing sheet 530A is placed over the first movable contact 520A and set on the lower face of the sub-board 240.

In this state, after the rear end portion of the folded-back piece 230 of the circuit board 200 is folded back, the distal end portion of the folded-back piece 230 is housed in the rectangular recessed portion 152 of the housing portion 150 of the case 100, while the sub-board 240, the first movable contact 520A, and the first fixing sheet 530A are housed in the circular recessed portion 151. At this time, the four engaging holes 241 of the sub-board 240 and the four engaging holes 531A of the first fixing sheet 530A are respectively engaged with the four first engaging protrusions 161 on the lower face of the circular recessed portion 151. In this way, the first movable contact 520A is retained between the first fixing sheet 530A and the sub-board 240. The first spacer 520A is also retained between the operation shaft main body 321 of the first operating body 300 and the first movable contact 520A.

Then, the three engaging holes 1120 of the reinforcing plate 1000 are engaged with the three second engaging protrusions 162 of the bottom plate of the case 100. As a result, the four first engaging protrusions 161 of the case 100 are fitted in the four housing holes 1110 of the reinforcing plate 1000.

A description will be made below on how to use the compound operation input device assembled as described above and how each portion of the device operates. First, when the first operating body 300 is pressed down from the initial state, the protrusion 322 of the first operating body 300 is guided between the two support members 120 of the case 100 and the first operating body 300 moves downward. Then, the operation shaft main body 321 of the first operating body 300 presses down the top portion of the first movable contact 520A through the first spacer 520A. The first movable contact 520A is thus elastically deformed, and the top portion thereof comes into contact with the other first fixed contact 510A. As a result, a signal indicating that the first operating body 300 has been pressed down is outputted to the electronic device via the circuit board 200.

Then, when the first operating body 300 is released, the first movable contact 520A returns to its original state. The first movable contact 520A pushes up the operation shaft main body 321 of the first operating body 300 through the first spacer 520A and returns the first operating body 300 to the initial state.

If the second operating body 400 in the parallel state is tilted in either one of the two directions along the longitudinal direction of the arms 620, the operation plate 410 of the second operating body 400 presses down the second protrusion 820 of the key top 800 on the tilted side. As a result, the second operating body 400, the key top 800, and the attachment 600 tilt while the guide protrusions 850 of the key top 800 are guided by the recessed guiding portions 140 of the wall of the case 100. In this way, the tilted-side pressing-down portion 840 of the key top 800 presses down the associated top portion of the second movable contact 520B through the second spacer 520B. In this way, the second movable contact 520B is elastically deformed, and the top portion thereof comes into contact with the other fixed contact 510B. As a result, a signal indicating that the second operating body 400 has been tilted is outputted to the electronic device via the circuit board 200.

During the above tilt operation, the two arms 620 of the attachment 600 swing along the longitudinal direction of the arms 620 in the two notches 711*b* of the rotating body 710.

When the second operating body 400 is released, the tilted-side second movable contact 520B returns to its original state. As a result, the tilted-side second movable contact 520B pushes up the tilted-side pressing-down portion 840 through the first spacer 520A. In this way, the second operating body 400 returns to the parallel state.

On the other hand, if the second operating body 400 in the parallel state is tilted in either one of the two directions along the width direction of the arms 620, the second operating body 400, the key top 800, and the attachment 600 tilt in a similar manner to the previously described tilt operation. A signal indicating that the second operating body 400 has been tilted is outputted to the electronic device via the circuit board 200.

At this time, the two arms 620 of the attachment 600 swing along the width direction of the arms 620 in the two notches 711*b* of the rotating body 710.

When the second operating body 400 is released, similarly to the previously described tilt operation, the second operating body 400 returns to the parallel state.

If the second operating body 400 is rotated, the second operating body 400, the tactile element 900, and the attachment 600 rotate. As a result, one of the two bent pieces 621 of each arm 620 of the attachment 600 comes into contact with and presses the associated end face of the notch 711*b* of the rotating body 710. In this way, the rotating body 710 and the contact 720 rotate in accordance with the rotation of the second operating body 400. Then, the four contact arms 722 of the contact 720 slide on the plurality of contact patterns 730 on the main board 210 of the circuit board 200. As a result, signals indicating rotation angle and a rotation direction of the second operating body 400 are outputted to the electronic device via the circuit board 200.

During the rotating operation, the two sliding portions 920 of the tactile element 900 slide on the uneven face 830 of the key top 800 to provide tactile feeling of operation in rotating operation of the second operating body 400.

In the compound operation input device embodied as described above, the rotation detector 700 is attached to the lower face of the inner wall 420 of the second operating body 400 via the attachment 600 and is disposed in dead space, that is, the space between the main board 210 of the circuit board 200 and the operation portion 310 of the first operating body 300 and inside the plurality of second switches 500B. This arrangement can reduce the outer size of the rotation detector 700. The effective use of the above dead space further contributes to a minimized device.

Moreover, the key top 800 performs dual functions, namely, pressing down any of the four second switches 500B, and giving a tactile feeling of operation to the rotating operation of the second operating body 400 with the help of the tactile element 900. In this regard, the number of parts can be reduced as compared with other compound operation input devices having separate components for achieving the respective the functions. As a result, the device described above is reduced in size and cost. Furthermore, because the key top 800 and the tactile element 900 are housed in the space between the inner wall 420 and the outer wall 430 of the second operating body 400, it is possible to reduce the thickness of the device, leading to reduced height of the device.

Any design change may be made to the shape of the case 100 as long as the case 100 can house the above-described components. For example, the case may further house the first switch.

The circuit board 200 in any shape may be used as long as it can be formed with contacts of the switches, the contact patterns of the rotation detector, and the like.

The first operating body 300 may be in any shape as long as it can be pressed in a direction substantially orthogonal to the circuit board to actuate the first switch. If the first operating body 300 is shaped to have the operation portion and the operation shaft, the operation portion may be in any shape. The shape of the operation shaft is only limited as a rod-like shape protruding from a portion of the second face of the operation portion and having smaller outer size than the operation portion.

The shape of the second operating body 400 is only limited as an annular shape to be disposed around the first operating body and substantially parallel to the board. Although it is described in the embodiment that the second operating body can be tilted in the four directions, it may be tilted in any radial directions.

The key top 800 may be omitted. In this case, at least members analogous to the pressing-down portions 840 are provided on the second face of the second operating body. To realize a tactile feeling of operation in the rotating operation of the second operating body while omitting the key top 800, the uneven face 830 may be provided on the second face of the second operating body, and the tactile element 900 may be fixed to the case or another element so as to slide on the uneven face.

The tactile element 900 may also be omitted. To realize a tactile feeling of operation in the rotating operation of the second operating body while omitting the tactile element 900, the second operating body may have protrusions on its second side and slide on the uneven face 830 of the key top 800.

Any type of the attachment 600 may be used as long as it has an outer portion, the second operating body being provided with the outer portion, and an inner portion facing the second face of the first operating body, and as long as the rotation detector to be described later can be attached to the attachment.

For example, the attachment may be rectangular plate-like bodies, one end portions (outer portions) of the plurality of attachments may be provided to the second operating body, and the other end portions (inner portions) may face the second face of the first operating body. Such attachments may be attached to the second operating body or may be provided integrally with the second operating body.

The "attachment" between the rotation detector and the inner portion of the attachment is not limited to complete fixing but includes an engaged state in which the arms 620 are fitted in the notches 711*b* as in the above-described embodiment.

Although it is described in the embodiment that the rotation detector 700 is a rotary switch, it is not limited thereto but may be a variable resistor having resistance patterns in place of the contact patterns 730, or may be a rotary encoder having magnetic detecting elements in place of the contact patterns 730 and a magnet in place of the contact 720. It is also possible to use an optical rotary encoder.

The rotating body 710 may be omitted. In this case, the contact 720 may be attached to the attachment 600.

Any type of first switch 500A may be used as long as it can be actuated in response to pressing movement of the first operating body. For example, the second face of the first operating body may be provided with the movable contact to be brought into contact with the fixed contact.

As to the second switches 500B, a similar type to the first switch 500A can be used. Moreover, the second switches only need to be disposed in positions on the circuit board outside the area facing the first operating body, the positions corresponding to tilt of the second operating body. Therefore, the number of the second switches is not limited to four as in the above embodiment.

What is claimed is:

1. A compound operation input device comprising:

a first operating body, pressably operable in a direction substantially orthogonal to a circuit board, and having a first face exposed for operation and a second face opposite from the first face;

a second operating body of annular shape, disposed around the first operating body and substantially parallel to the circuit board, tilt operable in any radial direction from the parallel state, and rotatably operable in a circumferential direction;

a first switch actuable in response to pressing movement of the first operating body;

a plurality of second switches independently actuable in response to tilt movement of the second operating body;

a rotation detector for detecting rotation of the second operating body; and an attachment including:

an outer portion, the second operating body being provided with the outer portion, and an inner portion facing the second face of the first operating body, wherein the plurality of second switches are disposed in an outer area on the circuit board outside an area on the circuit board facing the first operating body, and the rotation detector is attached to the inner portion of the attachment and disposed in a space between the circuit board and the first operating body and inside the plurality of second switches.

2. The compound operation input device according to claim 1, the first operating body comprising:

an operation portion having the first face and the second face, and a rod-shaped operation shaft protrudingly provided on a portion of the second face of the operation portion and having a smaller outer size than the operation portion, wherein the inner portion of the attachment faces the remaining portion of the second face of the operation portion.

3. The compound operation input device according to claim 2, the rotation detector comprising:

a rotating body having one heightwise end portion attachable to the inner portion of the attachment, a central portion of the rotating body being provided with a through-hole for receiving the operation shaft therethrough;

a contact provided on the other heightwise end portion of the rotating body; and a contact pattern provided in the area on the circuit board facing the first operating body, the contact being slidable on the contact pattern.

4. The compound operation input device according to claim 3, the attachment comprising:

a ring-shaped plate body attachable to the second operating body; and an arm extending from an inner face of the plate body, the arm having two bent pieces on opposite sides of a distal end portion thereof, wherein said one heightwise end portion of the rotating body is provided with a notch for fitting the arm therein.

5. The compound operation input device according to claim 1, further comprising:

a key top of annular shape, disposed between the second operating body and the second switches and substantially parallel to the circuit board, and tiltable in response to tilt movement of the second operating body so as to press the associated one of the second switches; and a tactile element provided on an area of the second operating body facing the key top, wherein a face of the key top facing the tactile element is uneven, and the tactile element is slidable on the face of the key top facing the tactile element.

6. The compound operation input device according to claim 5, the second operating body comprising:

a ring-shaped operation plate having a first face exposed for operation and a second face opposite from the first face;

a cylindrical outer wall extending from an outer edge portion of the second face of the operation plate; and a cylindrical inner wall extending from an inner edge portion of the second face of the operation plate, wherein the tactile element is attached between the outer wall and the inner wall of the second face of the operation plate and, the outer portion of the attachment is attached to the inner wall such that an outer end portion of the outer portion faces the second face of the operation plate, and the key top is supported on the outer end portion of the outer portion of the attachment and housed in a space between the outer wall and the inner wall.

* * * * *